United States Patent [19]

Molyneux

[11] 4,193,231

[45] Mar. 18, 1980

[54] SILLS FOR BUILDING CONSTRUCTION

[75] Inventor: George Molyneux, Plymouth, England

[73] Assignee: Radway Plastics Limited, Solihull, England

[21] Appl. No.: 879,565

[22] Filed: Feb. 21, 1978

[30] Foreign Application Priority Data

Jan. 28, 1978 [GB] United Kingdom ..... 3583/78

[51] Int. Cl.[2] ..... E06B 1/70

[52] U.S. Cl. ..... 52/97; 49/505

[58] Field of Search ..... 52/97, 58; 49/467, 468, 49/505

[56] References Cited

U.S. PATENT DOCUMENTS

| | | | |
|---|---|---|---|
| 2,089,380 | 8/1937 | Kammerer | 49/468 |
| 2,788,551 | 4/1957 | Hildreth | 49/467 |
| 3,762,100 | 10/1973 | Kempel | 49/468 |
| 3,967,412 | 7/1976 | Governale | 49/468 |

FOREIGN PATENT DOCUMENTS

| | | | |
|---|---|---|---|
| 1248899 | 8/1967 | Fed. Rep. of Germany | 52/97 |
| 2334133 | 1/1975 | Fed. Rep. of Germany | 52/97 |
| 429100 | 7/1967 | Switzerland | 52/97 |

*Primary Examiner*—J. Karl Bell
*Attorney, Agent, or Firm*—John C. Smith, Jr.

[57] ABSTRACT

The invention provides a structural assembly for use in a building comprising an elongate structural element for use in a frame (such as a window or door frame) in an opening in the wall of the building, said structural element providing an effective pocket open along one side thereof, and a sill which comprises an elongate plate-like element formed along its inner edge with an arcuate surface as seen in transverse section, whereby said sill is adapted for rocking motion about its inner edge, said inner edge of said sill being received within said pocket and said plate-like element extending laterally from said elongate structural element.

The invention also provides a sill for use in the structural assembly, wherein the inner edge of the sill is formed into a part cylindrical scroll, and wherein the outer edge is formed with a drip bead which as seen in transverse section has an arcuate surface facing inwardly, for engagement with the outer face of a wall of the building adjacent to an opening in which the sill is used.

14 Claims, 15 Drawing Figures

SILLS FOR BUILDING CONSTRUCTION

This invention relates to sills for use in building construction, the term "sill" being used herein in the conventional sense to describe a building detail which provides a platform projecting from a window, over the reveal beneath the window opening (outside or inside). However, a sill in accordance with the invention can be used to cover any of the reveals formed around a window or door opening (up the sides and across the top as well as in the conventional position across the bottom) and hence the term "sill" is used herein in this broader sense of anything which will cover a reveal in an opening in the wall of a building. The invention also includes structural assemblies which make use of sills—in the broad sense set forth above.

A basic problem in the fitting of window frames into buildings, is caused by the fact that the window frame together with its sub-frame if a sub-frame is used, does not always have an overall depth which is exactly equal to a number of courses of the building blocks used in the wall in which the window is fitted. Various expedients are used in the building trade, as a means of closing the opening underneath or above the window frame, due to lack of coincidence with courses of bricks. Thus, one method comprises building a course of bricks on edge under the window sill. Unless it so happens that a brick on edge will fill the required space, this requires cutting of the bricks, and this method is time consuming, expensive and contrary to good building practice. Invariably, it results in "straight joints"—i.e. alignment of vertical joints in adjacent courses of bricks—which is aesthetically unacceptable.

Another method which is sometimes adopted is that of laying a course of split bricks under the window sill. to begin with, this produces two horizontal mortar joints very close to each other, which is bad building practice, and it is extremely difficult to split the bricks smoothly enough to give a reasonable appearance on the outside of the building.

Yet another method which is frequently adopted, is the practice of leaving a gap at the top of the window frame. Strictly speaking, this gap should be filled by an additional piece of timber (though this is not in itself good building practice) but owing to the high cost of the timber, a more frequent practice is that of nailing a relatively thin cover piece or architrave on to the inside and outside faces of the frame head, to cover the gap above the frame.

Finally, it should be mentioned, that sometimes sills have been made of tiles. Now with a tiled sill, it is sometimes possible to overcome the difficulty referred to, because the sill can be inclined downwardly from the sill of the window frame to the outside of the wall, thus covering any opening between the top course of bricks below the window opening and the underside of the window frame. However tiled sills are infrequently used, because strictly speaking there should always be a double course of tiles to "break the joints" and this results in a very unsightly finish showing the ends of the tiles sandwiching a mortar joint. Perhaps even more of a problem is the fact that the tiles must overhang the brick wall on the outside in order to provide a drip edge spaced from the external face of the wall, and this overhanging portion of the tiles is very easily broken. In practice, such overhanging tile edges are often broken by window cleaners ladders.

The present invention aims at producing a sill and a structural assembly employing such a sill, which generally will be able to overcome the problem associated with matching the height of a window frame to the courses of bricks or other building blocks. At the same time, the invention also provides a sill having an overhanging drip bead, which is less vulnerable than drip beads formed on tiled sills.

According to one aspect of the invention a sill for use in building construction comprises an elongate plate-like element formed along its inner edge with an arcuate surface as seen in transverse section whereby the sill is adapted for rocking motion about its inner edge. Preferably, the inner edge of the sill is formed into a part cylindrical scroll (as seen in transverse section) to provide the arcuate surface by the exterior of the scroll.

According to a preferred feature of the invention, the outer edge of the sill is formed with a drip bead which as seen in transverse section has an arcuate surface facing inwardly, for engagement with the outer face of a wall of the building adjacent to an opening in which the sill is used. Preferably the drip bead is substantially cylindrical in transverse section, and it may take the form of a hollow cylinder.

According to another preferred feature of the invention, one or more anchorage formations project below the plate-like element of the sill and preferably, the or each anchorage formation is of inverted T-shape transverse section.

According to another aspect of the invention, a structural assembly comprises a structural element for use in a window or door frame in an opening in the wall of a building, with an effective pocket open along one side thereof, and a sill in accordance with the first aspect of the invention, with its inner edge received within the pocket and its plate-like element extending laterally from the structural element. Since the inner edge of the sill is formed with an arcuate surface, it is possible to rock the sill in the pocket formed in the structural element about an axis extending longitudinally of the sill. Thus, it is possible to form a bed of mortar on the top course of building blocks below a frame opening, fit the inner edge of the sill into the pocket formed in the structural element with the sill in a raised position where it is clear of the bed of mortar, and then depress the sill, turning it about its inner edge, so that it adopts an inclined position resting on the bed of mortar. It will be appreciated, that this provides an inclined sill effect, similar to that which it has been noted above can be obtained with the use of a tiled sill, but presenting the advantage, that since the sill is formed as a unitary structure, it is not necessary to employ a double course as with tiles. Furthermore, owing to the turning action as the sill is being fitted, it is possible to interengage anchorage formations projecting below the sill in the bed of mortar, so that the sill becomes firmly anchored to the mortar. This is particularly important, if the sill is formed of plastics material such as unplasticised polyvinylchloride (U.P.V.C.), because it is not possible to adhere a plastics sill to a mortar bed without the use of some kind of anchorage formation.

Now because of the facility for inclining the sill in the fitted position, it is possible to cover any gap which would otherwise occur underneath the frame between the sill member of the frame and the top surface of the course of bricks beneath the frame. Of course, there are limits to the depth of opening which can be covered in this manner, but in practice a reasonably wide variation is possible which will take care of the majority of circumstances likely to be encountered.

Moreover, a sill constructed in accordance with the preferred feature of the invention whereby the drip bead is substantially cylindrical in transverse section, is less liable to be damaged, for example by ladders, than a tiled sill. In fact, the cylindrical drip bead is a very strong structural feature, whilst at the same time it presents the conventional arcuate top outer edge to the sill. Another advantage of using a sill in accordance with the invention, is that as the sill is depressed on to the mortar bed, some of the mortar is squeezed into the recess formed in the angle between the plate-like element of the sill and the drip bead, and this assists in anchoring the sill to the wall.

According to another preferred feature of this aspect of the invention, the sill is formed with a part cylindrical scroll, and the pocket is of such a width (measured from the outside edge of the structural element to the inner edge of the pocket) that there is provision for adjustment of the lateral position of the sill relatively to the structural element. By use of this feature of the invention, it will be appreciated that the distance between the frame and the outer face of the wall can be varied within limits, so long as the scroll type inner edge of the sill is always located within the pocket.

According to another preferred feature of this aspect of the invention, the structural element comprises a strip like member and a detachable device attached to the strip-like member, the pocket being formed betweeen the strip-like member and an arm of the detachable device. The detachable device may be adapted to be received in a longitudinal groove in a side face of the strip-like member, and the latter may be constructed in accordance with U.S. Pat. No. 4,136,496.

The detachable device may be adapted to slide into the groove in the strip-like member from one end thereof, or it may be snap fitted into the groove in the strip-like member. Alternatively, in an arrangement in which the groove in which the detachable device is received is undercut, the detachable device may have a head which enters the groove when orientated in one direction and becomes secured in the groove by turning to another orientation.

According to another preferred feature of the invention, there are two effective pockets open on opposite sides of the structural element, and two sills each in accordance with the first aspect of the invention having their inner edges received respectively in the two pockets, so that the sills project from opposite edges of the structural element. With this construction, it will be appreciated that if the structural element forms part of a window, then one sill is on the outside of the window frame, and forms the conventional outer sill, and the other is on the inside, and will normally project horizontally from the inner edge of the window frame, to provide a window "board" or interior sill.

Preferably an end plug is provided which has a spigot adapted to enter the drip bead of the sill and a block adapted to blank off the end of the drip bead, and to abut against the face of the wall beyond the end of the opening.

The invention in all its aspects will be better understood, from the following specific description, exemplifying the invention, with reference to the accompanying drawings, in which.

Figure 8:
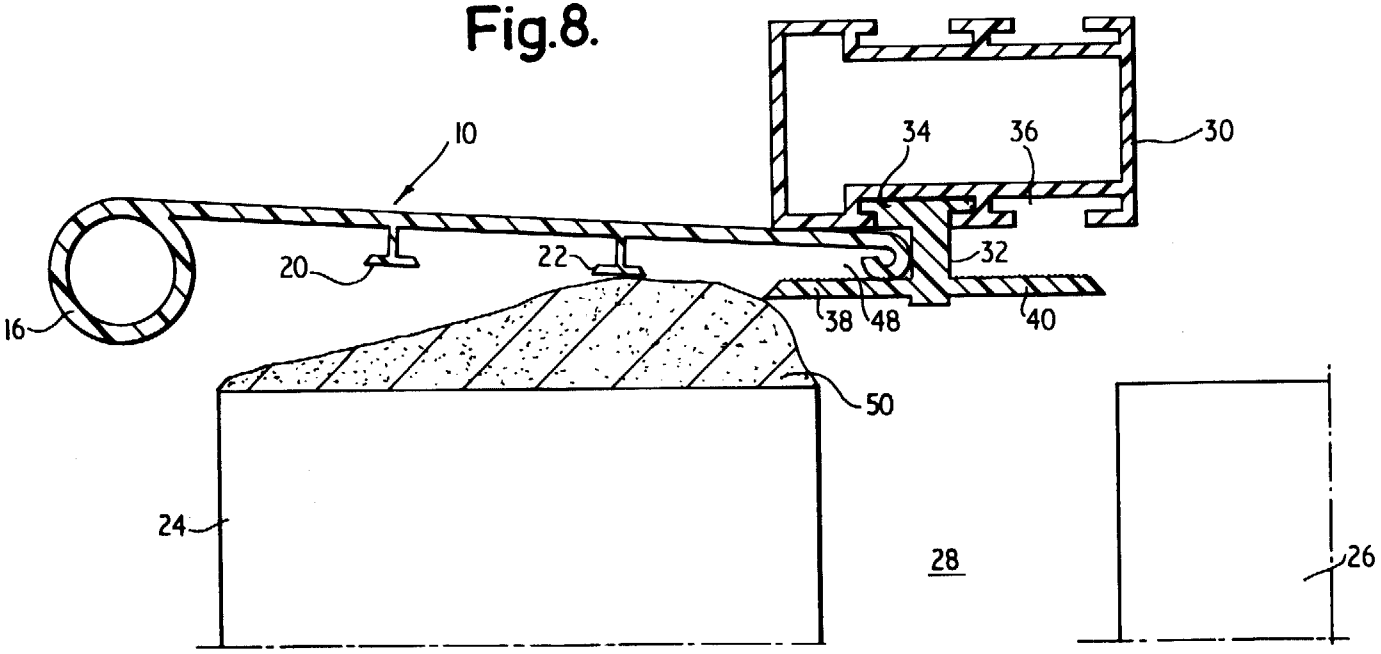
Figure 9:
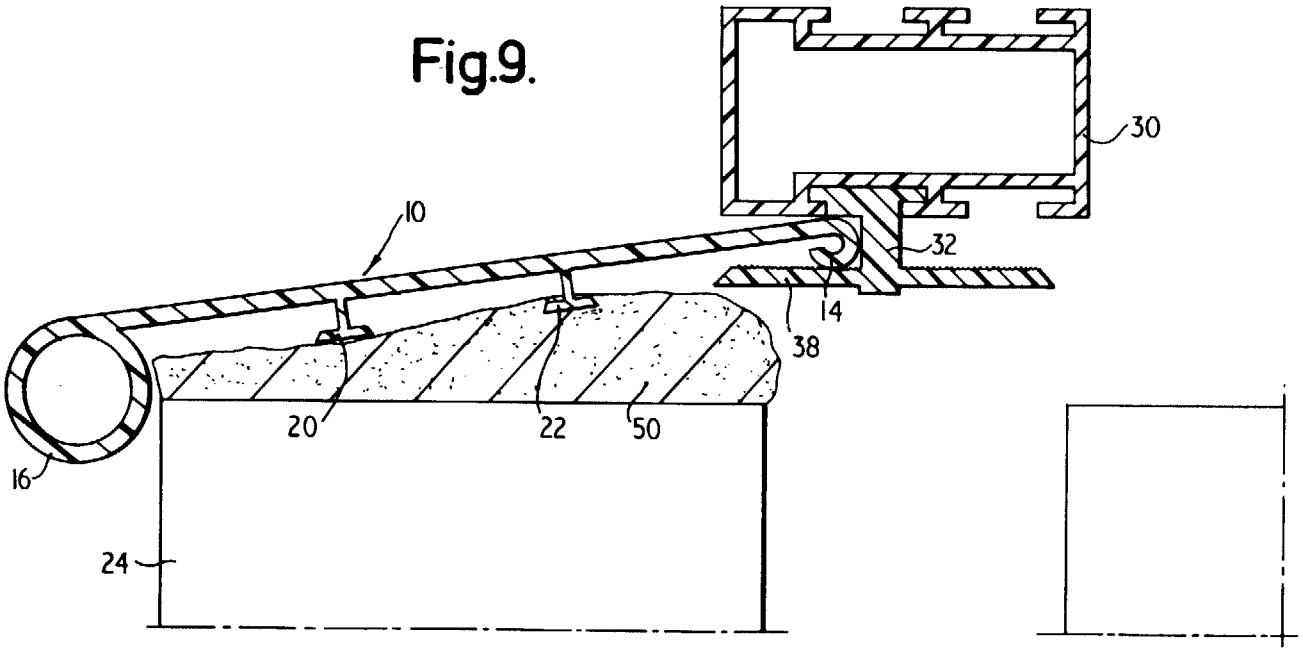
Figure 10:
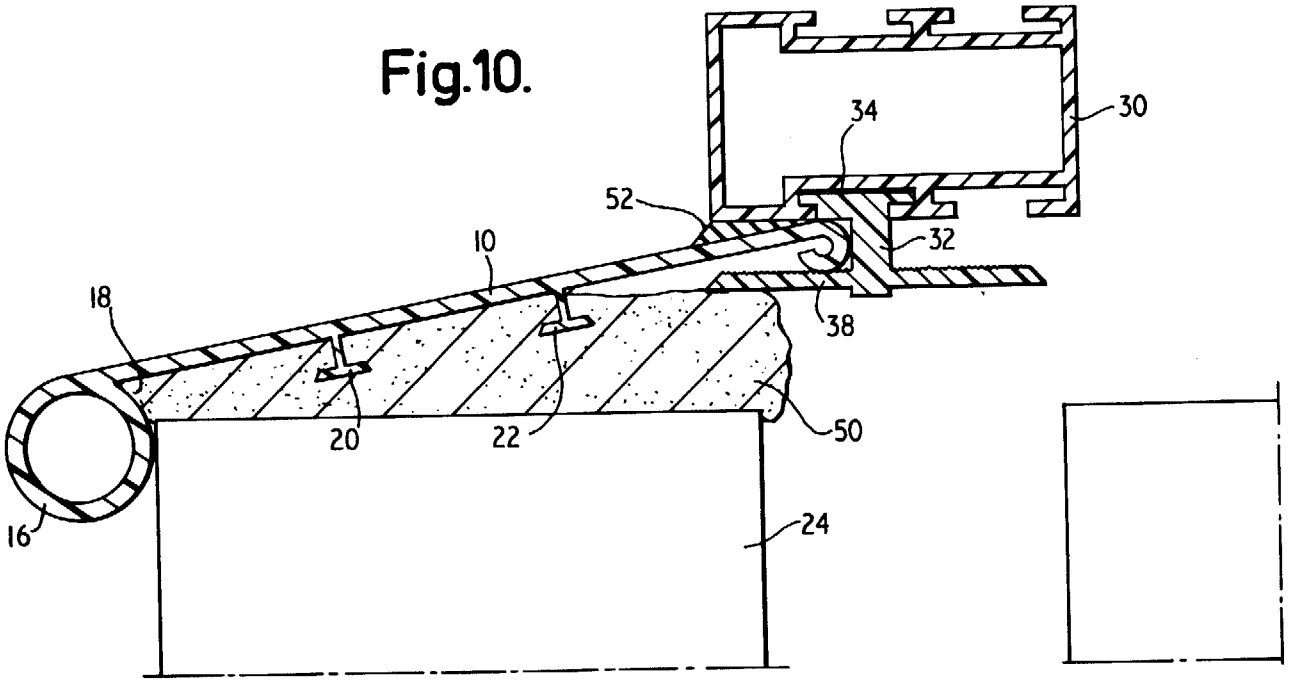
Figure 11:
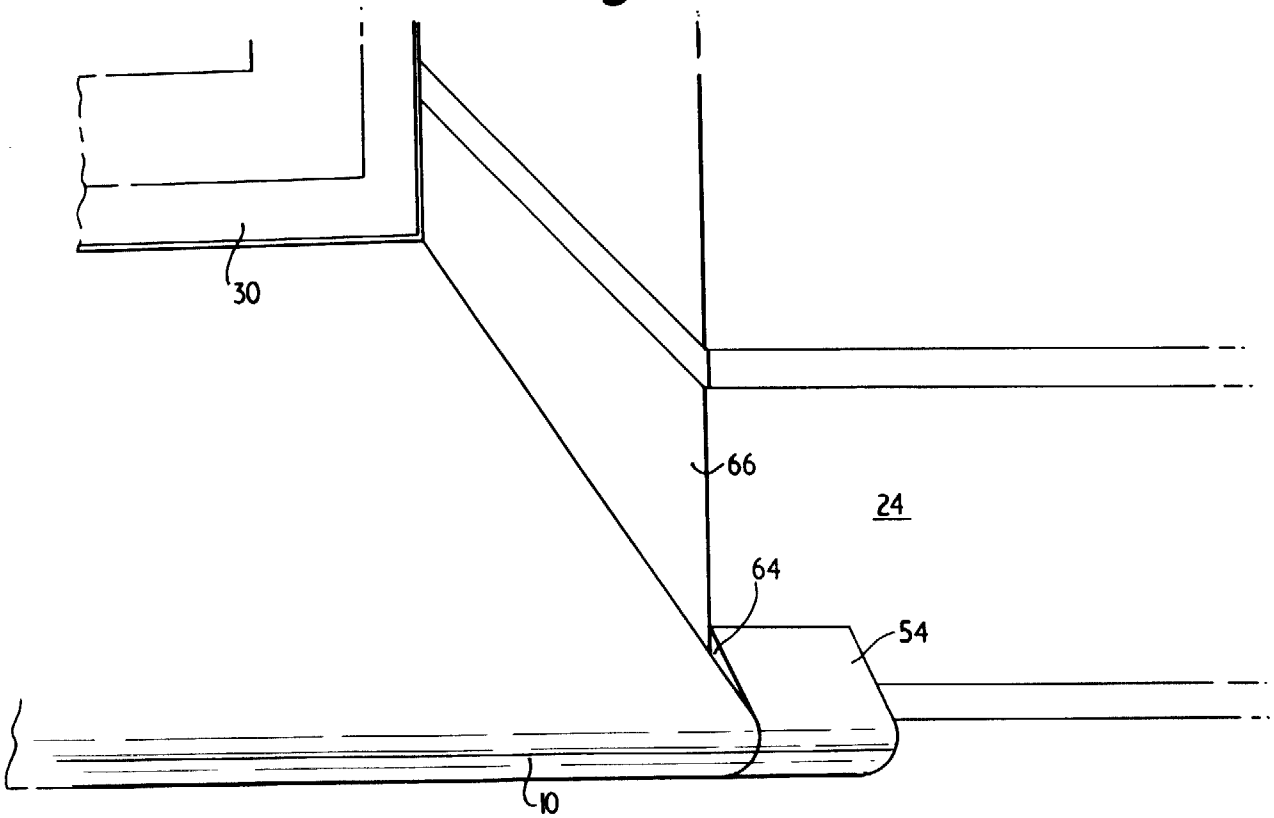
Figure 12:
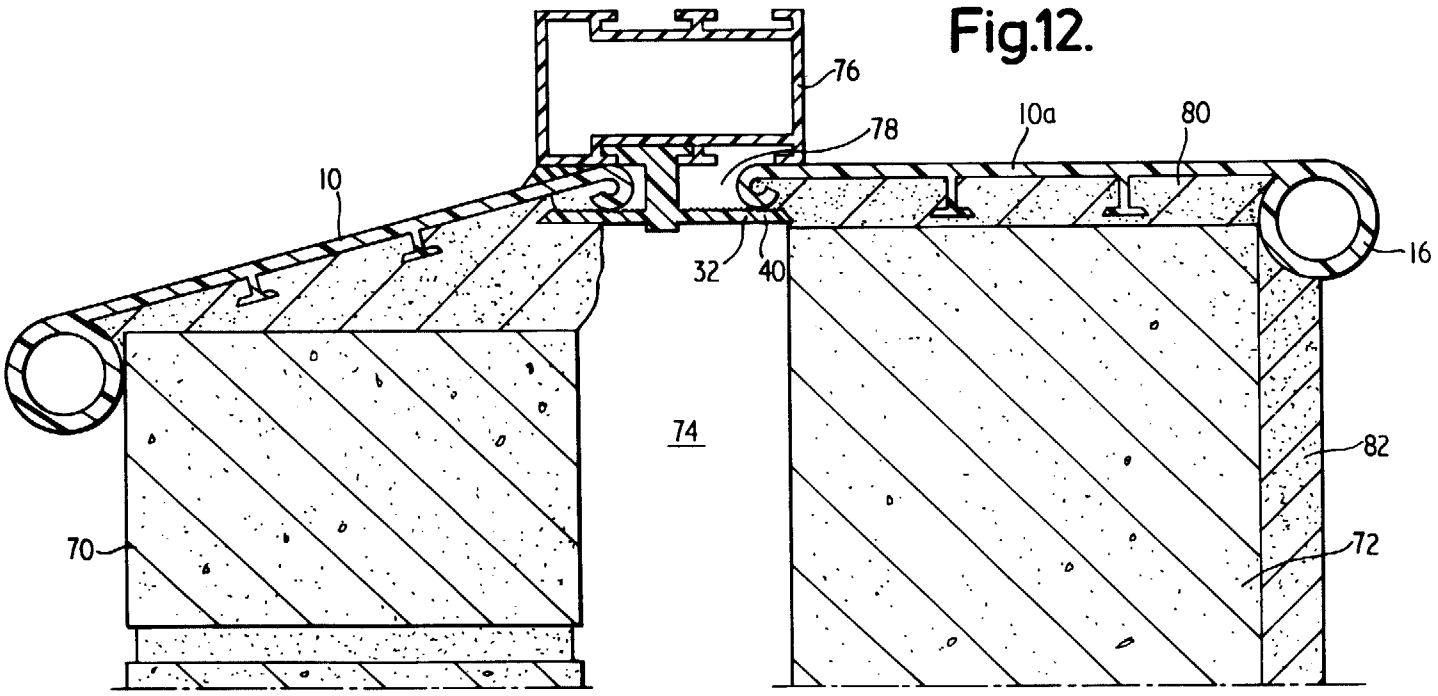
Figure 13:
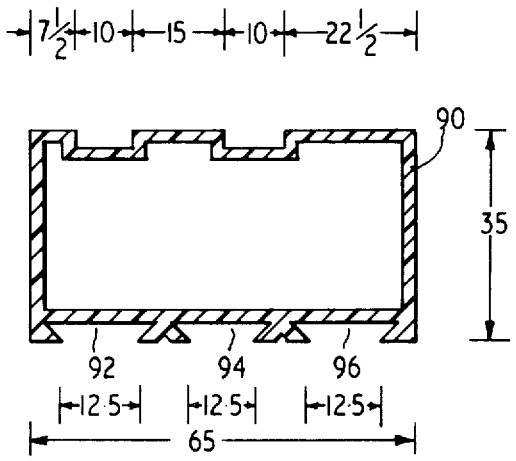
Figure 14:
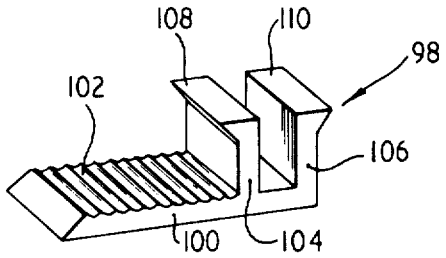
Figure 15:
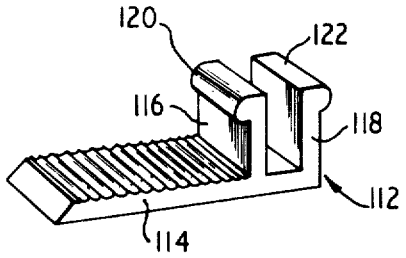

FIG. 8 is a cross-section through a cavity wall and window sub-frame, showing a first stage in the fitting of a sill, FIG. 9 is a view similar to FIG. 8, but showing a subsequent stage in the fitting of the sill, FIG. 10 is a view similar to FIG. 8, but showing the sill in the finished position, FIG. 11 is a perspective view of one end of a window frame opening, showing the sill and an end block in position, FIG. 12 is a transverse section through a cavity wall fitted with a window sub-frame and two sills, FIG. 13 is a cross-section through an alternative form of sub-frame for use with the invention, FIG. 14 is a perspective view of an alternative form of clip for use with the sub-frame illustrated in FIG. 13, and FIG. 15 is a perspective view of another form of clip for use with either the sub-frames shown in FIGS. 8 to 12, or that shown in FIG. 13.

A sill 10 for use in building construction is manufactured as an extrusion in unplasticised polyvinylchloride (U.P.V.C.) and because of its method of manufacture, it is of constant cross-section throughout its length. Consequently, it is only necessary to illustrate the cross-section in FIG. 1. It is intended that the extrusion shall be made in long lengths for stocking by a builders merchant, or by the builder on site, because it is possible to cut the extrusion to the required lengths for fitting in to window frame openings as and when required. Alternatively, lengths of the sill extrusion 10 may be precut to the length of preformed sub-frames, and supplied with the sub-frames.

Figure 1:
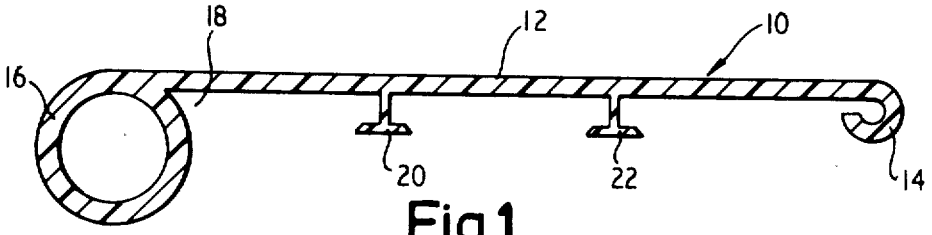
FIG. 1 is a transverse section through a sill.

Referring particularly to FIG. 1, it will be seen that the sill essentially comprises a plate-like element 12, the thickness of which is adequate to withstand handling during construction, and the expected applied loads in use. However, as will hereinafter appear, in use, the plate-like element is supported by mortar, and consequently can be relatively thin.

Along its inner edge, the sill 10 is curled under on itself as indicated at 14 to provide a scroll-like inner edge, having a part cylindrical outer surface. Small serrations may be formed on the outside of the scroll 14. This scroll formation performs an important function in the fitting of the sill as will hereinafter appear. Along its outer edge, the sill 10 is formed with a drip bead 16 in the form of a hollow cylinder, disposed so that the plate like element 12 projects tangentially from the cylinder 16. A bull nosed tile as used in sill construction has a curved outer edge which acts as a drip edge, but in the case of the sill 10, illustrated in FIG. 1, the drip edge will be constituted by the lowest point of the bead, which is on the vertical axis of the bead cylinder. It is a significant feature of the invention however, that the bead continues beyond the lowest point back up to the plate-like element 12, forming an arcuate inner surface, and a recess 18 between that arcuate inner surface and the underside of the plate-like element 12. Furthermore, the bead 16 has considerable resistance to applied loads, since its hollow cylindrical construction ensures that any such applied loads produce only hoop stresses within the bead 16.

At laterally spaced positions on the underside of the sill, there are two anchorage strips 20 and 22, each of which is of inverted T-shape in transverse section, the lower edge of each anchorage strip being approximately level with the underside of the scroll 14 formed along the inner edge of the sill.

The manner in which the sill illustrated in FIG. 1 can be fitted into a window frame opening on the outside of the window frame is illustrated in FIGS. 8, 9 and 10. Referring to those figures, a cavity wall has an outer leaf 24 and an inner leaf 26, with a cavity 28 between them. Each of the leaves of the wall is built up from blocks, and it is assumed that the outer leaf is built up from bricks, but the inner leaf is built up from larger building blocks such as breeze blocks. The sill member 30 of a plastic sub-frame for use with a metal window frame (not shown) is illustrated in FIGS. 8, 9 and 10, and it will be noted that the sub-frame is located in a position where it bridges the cavity 28. During the construction of the wall, the bricklayer will set the sub-frame—only the sill member 30 of which is illustrated—so that the head of the sub-frame coincides with the required level of a brick course bed, as marked out on the builders gauge. This means that the head of the sub-frame is correctly located, and will require no extension or cover strips. In accordance with conventional practice, the builder will leave off the top course of bricks in the outer leaf 24 below the sub-frame sill 30, and will insert a temporary piece of packing (not shown) beneath the sub-frame to hold the frame whilst the cavity wall is built up around the frame. Some time later, when the mortar employed in building the wall has set, it is necessary for the bricklayer to return, remove the temporary packaging, and then build in the top course of bricks in the outer leaf 24. Up to this point, the construction is entirely conventional.

It will be noted that the sill 30 of the sub-frame is formed as a hollow member, and that it has undercut grooves 34 and 36 in its bottom side face. Because the sill 30 is formed as an extrusion, the grooves 34 and 36 extend throughout the length of the sill. In fact, the sub-frame sill illustrated in FIGS. 8, 9 and 10, is constructed as described in the specification of U.S. Pat. No. 4,136,496.

Figure 5:
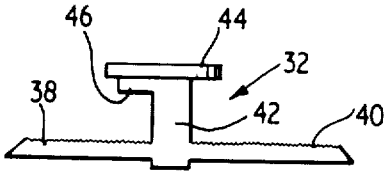
FIG. 5 is a side elevation of a clip.
Figure 7:
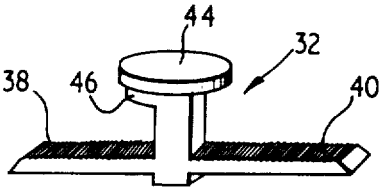
FIG. 7 is a perspective view of the clip shown in FIGS. 5 and 6.
Figure 6:
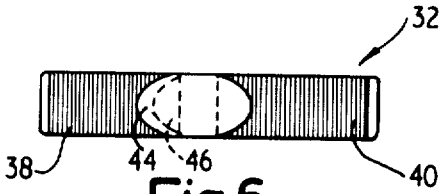
FIG. 6 is a plan view of the clip shown in FIG. 5.

A series of clips 32 (see FIGS. 5, 6 and 7) is provided for use with the window frame and with the sill 10, there being sufficient of these clips for one to be inserted about every 300 millimeters along the length of the sub-frame sill. Each of the clips 32 is a detachable device, and is manufactured as a moulding in nylon. Each clip has a pair of aligned horizontal arms 38 and 40 and it will be observed that these arms are chamfered at the ends, and formed with a plurality of transverse serrations in their upper side faces. Near to the centre of the clip, there is an upstanding column 42 surmounted by a head 44, which as seen in FIG. 6, is of the same width as the column 42, but is elliptical in plan, so that its length is greater than its width. A shoulder piece 46 extends forwardly from the column 42 under the head 44, but stops short of the front of the head 44. Now the dimensions of the clip 32 are such, that the head 44 can only be inserted through the mouth of one of the grooves 34 and 36 in the sub-frame sill 30, when the clip is orientated, so that its arms 38 and 40 extend longitudinally with respect to the sill 30. However, when the clip 32 is turned through 90° about a vertical axis from this first orientation, to a position as illustrated in FIG. 8, where the arms 38 and 40 extend transversely with respect to the sill 30, then the head 44 just fills the width of one of the grooves 34 and 36, and the clip is located laterally by the front edge of the shoulder piece 46 and the rear edge of the column 42 engaging respectively against the inside edges of the mouth of the groove. Hence, the clip 32 can be easily fitted to the sill 30, by simply pushing the head 44 upwardly into the groove 34 in the sill, and then turning the clip through 90°, into the position illustrated in FIG. 8. As has been mentioned, clips 32 are secured to the underside of the sill 30 at approximately 300 millimeters spacings, and this then provides a set of fingers formed by the arms 38 pointing outwardly beneath the sill, and a set of fingers formed by the arms 40 pointing inwardly. As seen from the end, there is thus formed an effective pocket indicated at 48 in FIG. 8 between the underside of the sill 30, and the top sides of the arms 38.

It is preferable to have the clips 32 as detachable elements, rather than to have fingers moulded integral with the sill 30, partly because this maintains the versatility of the sill 30 (as more particularly described in the specification of U.S. Pat. No. 4,136,496) and partly because it is undesirable for the sill member to have projecting fingers, which could easily be damaged in transit or during erection on site.

The top course of bricks is then laid on the outer leaf 24, but in most instances, there will still be a gap between the top surface of the outer leaf 24, and the underside of the fingers 38. This gap is roughly filled, by laying mortar 50 on top of the top course of bricks, the bed of mortar being built up to the level of the fingers 38 on the inside, but tapering somewhat towards the outside of the leaf 24 as indicated in FIG. 8.

At that stage, the inner edge of the sill 10 is inserted into the pocket 48 formed under the sill member 30, and it should be explained, that this pocket is of approximately the same depth as the thickness of the scroll formation 14 along the inner edge of the sill. Consequently, the scroll formation is a close fit against the underside of the sill 30, and the top serrated surfaces of the fingers 38. The sill 10 will be positioned horizontally, or perhaps even upwardly inclined towards the outside, and consequently its anchorage strips 20 and 22 will be either clear of the mortar 50, or only just touching that mortar. The lateral position of the sill 10 relatively to the sub-frame sill 30 is adjusted, so that the inside face of the drip bead 16 is only just clear of an upward continuation of the outer leaf 24, and then pressure is exerted on the top of the sill 10, so that it begins to turn downwardly, rocking about its inner edge, as indicated in FIG. 9. The arcuate outer surface of the scroll formation 14 permits this rocking motion, whilst maintaining the scroll in engagement with the underside of the sill 30 and the top sides of the fingers 38, and hence there is a simple pivoting action of the sill 10. (The serrations on the top surfaces of the fingers 38, and on the scroll 14 prevent sliding of the sill relatively to the member 30, whilst permitting the rolling action of the scroll in the pocket).

During the downward motion of the sill, the anchorage strips 20 and 22 are pushed into the mortar 50, and the drip bead 16 is eventually brought into a position where its inner surface engages with the outer face of the outer leaf 24, the sill finishing in the position illustrated in FIG. 10. During the final stage of the motion of the sill, it is pressed inwardly as far as possible, so that its drip bead 16 engages firmly against the outer face of the leaf 24, and some mortar is thereby forced into the pocket 18, which assists in anchoring the sill 10 to the outer leaf. Thereafter, mortar cannot escape over the outer edge of the wall and consequently the mortar will be compressed. It then applies an upwardly directed force against the underside of the inner region of the sill pressing the scroll 14 against the underside of the sill member 30. The anchorage strips 20 and 22 also effectively anchor the sill 10 to the bed of mortar 50 when the latter sets. In this way, the sill is secured in position on the outer leaf, and at its inner end engages firmly against the underside of the sill 30. If the inner end of the sill 10 should be under the mouth of the groove 34, then it will still engage firmly against the undersides of the shoulder pieces 46 formed on the clips 32. In any event, a mastic joint 52 is preferably used between the sill member 30 and the top surface of the sill 10.

Now clearly, water falling onto the top surface of the sill 10 will be directed outwardly, and will drip off the drip bead 16 at the lowest position of that bead, which is spaced some distance outwardly from the outer surface of the wall 24. Clearly also, it is possible to accommodate different lateral positions of the window frame relatively to the cavity wall, by virtue of the length of the pocket 48, since the sill 10 can be fitted so long as its scroll portion 14 remains within the pocket 48. Moreover as has been pointed out, the drip bead 16 is relatively strong, and is well able to withstand applied loads such as the pressure exerted by a ladder.

Figure 2:
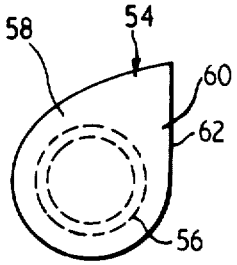
FIG. 2 is an outer end view of an end plug.
Figure 3:
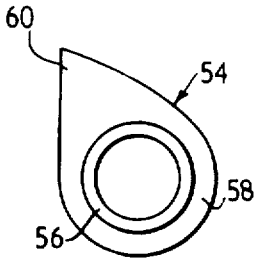
FIG. 3 is an inner end view of the end plug.
Figure 4:
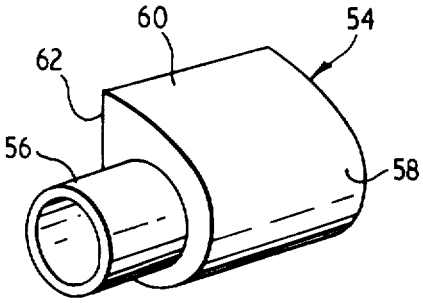
FIG. 4 is a perspective view of the end plug looking from the inner end.

If the ends of the drip bead 16 were left open, they could be rather unsightly, and dirt would become lodged in the bead. However, end plugs 54 (see FIGS. 2, 3 and 4) are provided for closing the ends of the drip bead 16. Each end plug is moulded in U.P.V.C. material similar to that from which the sill 10 is formed, and preferably it is made of the same colour as the sill. The end plug 54 has a short tubular spigot 56 which is a push fit in the drip bead 16, an end block 58 which completely blanks off the outer end of the spigot 56, and has a shape such that it largely coincides with the outside diameter of the drip bead 16, but also includes a lobe 60 extending upwardly from the spigot portion there being a flat edge 62 formed on the block 58. FIG. 11 shows how an end plug 54 is fitted to the end of a sill 10, the spigot 56 being inserted in the drip bead 16, the flat inner edge 62 bearing against the outer surface of the leaf 24 of the wall. In many cases, there will be a slight reveal 64 between the inner end of the lobe 60 and the end of the sill 10, but this is acceptable, because it is aligned with the reveal 66 formed in the leaf 24 on the outside of the window frame. It will be appreciated that the special shape of the end block 58 is required to accommodate possible different inclinations of the sill 10 depending upon the location of the top surface of the top course of bricks in the outer leaf 24 relatively to the underside of the sill member 30 of the sub-frame.

Turning now to FIG. 12, there is illustrated a cavity wall comprising an external leaf 70, an inner leaf 72 and a cavity 74 between the two leaves. The wall itself is assumed to be built up in similar fashion to that described with reference to FIG. 8. Also, a sill member 76 similar to the sub-frame sill member 30, is fitted over the cavity 74, clips 32 are secured to the underside of the sill member 76, and a sill 10 is fitted between the underside of the sill member 76 and the outer leaf 70 of the wall, in the same manner as has been described with reference to FIGS. 8 to 10 of the drawings.

However, in this construction, the internal block wall 72 has a top edge just below the level of the fingers 40 on the clips 32. In general, it is relatively easy to ensure that the top edges of the internal leaf of the wall are positioned where required, because the internal blocks are usually easier to trim than the external brick work, and in any event, the internal blocks are completely concealed in the finished construction.

A pocket 78 is formed between the underside of the sill member 76 and the top surfaces of the fingers 40, on the inside of the window sub-frame. A layer of mortar 80 is laid on top of the inner leaf 72, and then a second sill **10*a* similar to the sill 10, is fitted by pushing it inwardly and downwardly to the position illustrated in FIG. 12, where its inner scroll edge is received in the pocket 78, and its drip bead 16 is pressed against the inside face of the inner leaf 72. The inside sill 10*a*, will always be fitted with its top surface in a horizonal position, because it acts as a substitute for the conventional window board fitted across the bottom of the inside reveal of the window opening. The anchorage strips 20 and 22 become embedded in the mortar 80, thus securing the inside sill 10*a* to the inner leaf 72. Furthermore, there is latitude for variation in the positioning of the sill member 76 relatively to the cavity wall, by virtue of the length of the pocket 78. Since the bed of mortar 80 has to come part way up the depth of the pocket 78, it may be found desirable to fit the sill 10*a* in an upwardly and inwardly inclined orientation, until the scroll portion 14 has entered the pocket 78, when the sill 10*a*, can be turned about its inner end as described in relation to the outer sill 10**.

The inside sill can be completed either by fitting end plugs 54, or by fitting simple cylindrical plugs into the ends of the drip bead 16. Finally, the usual plaster layer 82 is applied to the inside surface of the inner leaf 72, and as this plaster layer will have an inner surface approximately coincident with the vertical diameter of the bead 16, the resulting appearance of the inside sill is exactly the same as that of the conventional window board. However, it will be appreciated that the advantage of the construction illustrated in FIG. 12, is that by the use of a single set of clips 32, and a single type of sill 10, it is possible to provide both the outside sill and the window board used in conjunction with a window in a cavity wall.

FIG. 13 illustrates the cross-section through an alternative form of sub-frame sill element 90, having a series of three dovetail shaped grooves 92, 94 and 96 in its underside. This sill member can also be made as an extrusion in U.P.V.C., and in fact may be constructed as described in the specification of U.S. Pat. No. 4,136,496. When it is used instead of the sill 30 or 76 illustrated in FIGS. 8 and 12, then the head of the clips 32 can be shaped differently to that illustrated in FIGS. 5, 6 and 7. Referring to FIG. 14, there is shown a clip 98, suitable for use in any of the grooves 92, 94 and 96, for forming a pocket under the sill member 90 of the sub-frame, for receiving a sill 10. The clip has a single horizontal arm 100 with a serrated top surface 102 and a pair of spaced up-right members 104 and 106, each of which is formed with a triangular lip 108 and 110 at its upper end, the arrangement of the lips 108 and 110 being such that they are capable of engaging snugly in one of the dovetail cross-section grooves 92, 94 and 96 in the underside of the sill member 90. When it is required to fit a clip 98, it is placed under the sill member 90, and nipping pressure is applied to the two upright members 104 and 106, so that the lips 108 and 110 are drawn towards each other until those lips will pass through the mouth of the groove in the sill member 90. The clip 98 is then pushed upwardly, and pressure on the upright members 104 and 106 is released, so that they spring outwardly, pushing their respective lips 108 and 110 into engagement with the edges of the dovetail shaped groove. In practice, since there are no large downwardly applied loads effecting the clips 98, it is unlikely that they will become dislodged from the dovetail shaped grooves in the sill member 90.

As an alternative to this snap action fitting of the clip 98 in one of the grooves in the sub-frame sill, the clips could be inserted into one end of the groove, and slid along it to their required operating positions.

It will be appreciated, that a modified clip could be made, with two arms similar to the clip 32, but having upright members 104 and 106 near to the centre of its length, so that the clip is adapted to receive both inside and outside sills as illustrated in FIG. 12, but it is fitted to the sub-frame sill by either the snap action or sliding from one end as just described.

FIG. 15 shows another form of clip 112 which could be fitted into any of the sill members illustrated at 30, 76 and 9 in FIGS. 8, 12 and 13 and this clip has a horizontal arm 114 and two spaced apart upright members 116 and 118 similar to the upright members 104 and 106, but in this case, the lips 120 and 122 formed at the upper ends of the upright members 116 and 118 are rounded, so that they are more easily adapted to the snap-action fitting in the grooves of the sill member. In practice as the clip is forced upwardly into a groove the edges of the groove engage with the rounded lips 120 and 122 and this causes the members 116 and 118 to move towards each other until the lip 120 and 122 can pass into the groove.

In all the assemblies described above, it has been assumed that the sill 10 is fitted across the bottom of the window frame. It will be appreciated however, that the sill could also be fitted across the head of the window opening, and/or up the sides of the window opening.

I claim:

1. A structural assembly comprising an elongate structural element for use in a frame in an opening in the wall of a building, said structural assembly defining an effective pocket open along one side thereof, and a sill which comprises an elongate plate-like element formed with an inner edge portion comprising an arcuate surface, as seen in transverse section, said inner edge portion being received within said pocket and said plate-like element extending from said structural element; the width of said pocket being greater, measured from the outside open edge of said structural element to the inner end of said pocket, than the cross-sectional width of said inner edge portion, whereby said sill, while said inner edge portion is retained in said pocket, may be both pivoted about its inner edge portion and adjusted laterally with respect to said elongate structural element.

2. A structural assembly according to claim 1 wherein the depth of said pocket, measured transversely to said elongate structural assembly and to said measured width of said pocket, is approximately the same as the thickness of said inner edge portion of said sill forming a close fit between said structural assembly and said inner edge portion of said sill.

3. A structural assembly according to claim 1, wherein said elongate structural element comprises a strip-like member and at least one detachable device attached to said strip-like member and having at least one arm, said pocket being formed between said strip-like member and said arm of said detachable device.

4. A structural assembly according to claim 3, wherein said detachable device is adapted to be received in a longitudinal groove in a side face of said strip-like member.

5. A structural assembly according to claim 1, wherein the inner edge of said sill is formed into a part-cylindrical scroll (as seen in transverse section) to provide said arcuate surface by the exterior of said scroll.

6. A structural assembly according to claim 1, wherein an outer edge of said sill is formed with a drip bead which as seen in transverse section has an arcuate surface facing inwardly, for engagement with the outer face of a wall of the building adjacent to an opening in which said sill is used.

7. A structural assembly according to claim 6, wherein said drip bead is substantially cylindrical in transverse section.

8. A structural assembly according to claim 1, wherein at least one anchorage formation projects below said plate-like element of said sill.

9. A structural assembly comprising an elongate structural element for use in a frame in an opening in the wall of a building, said structural element comprising a strip-like member; at least one detachable device having an arm and means for detachably connecting said strip-like member; said detachable device being connected to said strip-like member so that an effective open-ended pocket is formed between said strip-like member and said arm; and a sill which comprises an elongate plate-like element formed with an inner edge portion having an arcuate surface as seen in transverse section, said inner edge portion being received within said pocket and said plate-like element extending from said structural element, whereby said sill is adapted for rocking motion about its inner edge within said pocket.

10. A structural assembly comprising an elongate structural element for use in a frame in an opening in the wall of a building, said structural assembly defining an effective pocket open along one side thereof, and a sill which comprises an elongate plate-like element formed with an inner edge portion having a part cylindrical scroll configuration providing an arcuate surface as seen in transverse section, said inner edge portion being received within said pocket, and said plate-like element extending from said structural element, whereby said sill, while said inner edge portion is retained in said pocket, may be pivoted about its inner edge portion.

11. A structural assembly according to claim 10 wherein the depth of said pocket, measured transversely to said elongate structural assembly, is approximately the same as the thickness of said inner edge portion of said sill forming a close fit between said structural assembly and said inner edge portion of said sill.

12. A structural assembly comprising an elongate structural element for use in a frame in an opening in the wall of a building, such structural assembly defining an effective pocket open along one side thereof, and a sill which comprises an elongate plate-like element having an inner edge portion received within said pocket and extending from said structural element; the outer edge of said sill being formed with a drip-bead, which as seen in transverse section has an arcuate surface facing inwardly for engagement with the outer face of a wall of the building adjacent to an opening in which said sill is used.

13. A structural assembly according to claim 12 wherein said drip-bead is substantially cylindrical in transverse section.

14. A sill for use in building construction which comprises an elongate plate-like element, a part cylindrical scroll, as seen in transverse section, formed along the inner edge of the plate-like element to provide an arcuate surface on the exterior of said scroll whereby said sill may be pivoted about its inner edge when said part cylindrical scroll is received in a pocket; a drip-bead which is substantially cylindrical, as seen in transverse section, formed along the outer edge of plate-like element to provide an arcuate surface on the exterior thereof engageable with the outer wall of a building adjacent to an opening therein in which said sill is used and at least one anchorage formation projecting below said plate-like element adapted to be embedded in the material of said wall.

* * * * *